US007984753B2

(12) United States Patent
Ohfune et al.

(10) Patent No.: US 7,984,753 B2
(45) Date of Patent: Jul. 26, 2011

(54) HEAT EXCHANGER

(75) Inventors: Yuu Ohfune, Anjo (JP); Takayuki Hayashi, Nagoya (JP)

(73) Assignee: Denso Corporation, Kariya (JP)

( * ) Notice: Subject to any disclaimer, the term of this patent is extended or adjusted under 35 U.S.C. 154(b) by 939 days.

(21) Appl. No.: 11/975,151

(22) Filed: Oct. 17, 2007

(65) Prior Publication Data

US 2008/0169093 A1 Jul. 17, 2008

(30) Foreign Application Priority Data

Oct. 18, 2006 (JP) ..... 2006-284190
Mar. 5, 2007 (JP) ..... 2007-054631

(51) Int. Cl.
*F28F 3/00* (2006.01)
*F28D 7/10* (2006.01)

(52) U.S. Cl. ..... 165/166; 165/157

(58) Field of Classification Search ..... 165/165, 165/166, 167, 168, 164, 169, 157, 159
See application file for complete search history.

(56) References Cited

U.S. PATENT DOCUMENTS

| | | | | |
|---|---|---|---|---|
| 4,688,631 | A * | 8/1987 | Peze et al. | 165/166 |
| 5,893,408 | A * | 4/1999 | Stark | 165/66 |
| 6,293,337 | B1 * | 9/2001 | Strahle et al. | 165/166 |
| 6,516,874 | B2 * | 2/2003 | Mathur et al. | 165/166 |
| 6,595,274 | B2 | 7/2003 | Hayashi et al. | |
| 6,920,918 | B2 * | 7/2005 | Knecht et al. | 165/157 |
| 7,032,577 | B2 | 4/2006 | Rosin et al. | |
| 7,168,419 | B2 | 1/2007 | Rosin et al. | |
| 7,854,255 | B2 * | 12/2010 | Nakamura | 165/166 |
| 2005/0199227 | A1 | 9/2005 | Juschka et al. | |
| 2005/0199381 | A1 | 9/2005 | Mercz | |
| 2006/0219394 | A1 * | 10/2006 | Martin et al. | 165/157 |
| 2007/0193732 | A1 | 8/2007 | Oofune et al. | |
| 2007/0289581 | A1 | 12/2007 | Nakamura | |
| 2008/0087409 | A1 | 4/2008 | Nakamura | |

(Continued)

FOREIGN PATENT DOCUMENTS

| | | |
|---|---|---|
| DE | 199 62 863 | 6/2001 |
| DE | 1999 62 863 | 6/2001 |
| DE | 102 18 521 | 11/2003 |
| EP | 0 987 427 | 1/2004 |
| EP | 1 288 603 | 7/2006 |

(Continued)

OTHER PUBLICATIONS

Office Action dated Oct. 14, 2009 in corresponding German Application No. 10 2007 049665.8.

(Continued)

*Primary Examiner* — Tho v Duong
(74) *Attorney, Agent, or Firm* — Harness, Dickey & Pierce, PLC

(57) ABSTRACT

A heat exchanger includes first tubes and a second tube in a casing. The first tubes and the second tube are arranged in layers such that first spaces are provided between the adjacent first tubes and a second space is defined on a periphery of the second tube. Ends of the first tubes and the second tube are connected to a core plate such that first fluid passages defined inside of the first tubes and the second tube are in communication with a connection flange and the first and second spaces are separated from the connection flange. The casing includes an expansion that is in communication with the first spaces, and a side wall that is in contact with a side wall of an end first tube that is located adjacent to the second tube such that the second space is separated from the first spaces and the communication chamber.

10 Claims, 9 Drawing Sheets

U.S. PATENT DOCUMENTS

| | | | | |
|---|---|---|---|---|
| 2008/0110595 | A1 * | 5/2008 | Palanchon | 165/103 |
| 2008/0135221 | A1 | 6/2008 | Nakamura | |
| 2010/0263610 | A1 | 10/2010 | Mercz et al. | |

FOREIGN PATENT DOCUMENTS

| | | |
|---|---|---|
| JP | 2004-257366 | 9/2004 |
| WO | WO 02/052142 | 7/2002 |

OTHER PUBLICATIONS

Office Action dated Jul. 10, 2009 in corresponding Chinese Application No. 200710167131.9.

Office Action dated Jan. 25, 2011 in corresponding Japanese Application No. 2007-54631.

* cited by examiner

HEAT EXCHANGER

CROSS REFERENCE TO RELATED APPLICATION

This application is based on Japanese Patent Applications No. 2006-284190 filed on Oct. 18, 2006 and No. 2007-54631 filed on Mar. 5, 2007, the disclosures of which are incorporated herein by reference.

FIELD OF THE INVENTION

The present invention relates to a heat exchanger, which is for example used as an exhaust gas heat exchanger for an exhaust gas recirculation system of an internal combustion engine for performing heat exchange between an exhaust gas and a coolant.

BACKGROUND OF THE INVENTION

In an exhaust gas recirculation system (hereafter, EGR system), an exhaust gas discharged from an internal combustion engine is partly returned to an intake side of the engine. An exhaust gas heat exchanger is disposed to perform heat exchange between a coolant and the part of the exhaust gas (hereafter, EGR gas) to be returned to the intake side of the engine, thereby to cool the EGR gas.

In the EGR system, the volume of nitrogen oxide is reduced. Since the EGR gas is returned to the intake side of the engine after being cooled by the heat exchanger, the effect of reducing the nitrogen oxide further improves. If the EGR gas is merely recirculated, the amount of particulate maters emissions and the amount of hydrocarbon emissions will increase according to operation conditions of the engine. That is, the EGR gas has an optimum temperature that can reduce the amount of nitrogen oxide emissions and particulate matters.

Japanese Patent Publication No. 2004-257366 discloses an EGR heat exchanger for an EGR system. The disclosed heat exchanger having EGR cooling passages for cooling the EGR gas by an engine coolant and bypass passages in which the EGR gas is not cooled. The bypass passages are surrounded by air-filled layers so that the EGR gas passing through the bypass passages is not cooled. The EGR cooling passages and the bypass passages are disposed parallel to each other. In the disclosed EGR system, the volumes of the EGR gas flowing into the EGR cooling passages and the bypass passages are controlled by a switching valve that is connected to the EGR heat exchanger in series, thereby to control the EGR gas temperature to the optimum temperature.

In the disclosed EGR heat exchanger, cooling tubes that define the EGR cooling passages and bypass tubes that define the bypass passages are stacked in an inside of a tubular casing. Bonnets are coupled to ends of the tubular casing for fixing the EGR heat exchanger to an EGR gas passage of the EGR system. In the casing, a separation wall is provided between the cooling tubes and the bypass tubes such that the inside of the casing is separated into two spaces.

The cooling tubes are disposed in a first space and the bypass tubes are disposed in a second space. The engine coolant is introduced into the first space, so that heat exchange is performed between the engine coolant and the EGR gas passing through the cooling tubes through the cooling tubes. On the other hand, air is enclosed in the second space, in place of the engine coolant. Namely, air-filled layers are formed outside of the bypass tubes in the second space. Therefore, the EGR gas passing through the bypass tubes is hardly cooled. In this construction, however, it is necessary to air-tightly and entirely fix the separation wall to inner surfaces of the casing.

SUMMARY OF THE INVENTION

The present invention is made in view of the foregoing matter, and it is an object of the present invention to provide a heat exchanger for performing heat exchange between a first fluid and a second fluid, which has a structure capable of separating a space in which the heat exchange is not performed from a space in which heat exchange is performed without requiring the separation wall.

According to an aspect of the present invention, a heat exchanger includes a casing, a plurality of first tubes, and a second tube. The plurality of first tubes are disposed in the casing and layered at predetermined intervals such that first spaces are provided between the adjacent first tubes. The first tubes define first fluid passages inside thereof for allowing the first fluid to flow. The first spaces defines second fluid passages for allowing the second fluid to flow. The second tube is disposed in the casing and along an end first tubes, which is one of the plurality of first tubes and disposed at an end layer, such that a second space is defined on a periphery of the second tube. The second tube defines another first fluid passage inside thereof for allowing the first fluid to flow. The heat exchanger further includes a connection flange and a core plate. The connection flange is disposed at ends of the first tubes and the second tube. The core plate is coupled to the ends of the first tubes and the second tube such that the first fluid passages are in communication with the connection flange, and the second fluid passages and the second space are separated from the connection flange. The casing includes a casing side wall and a first expansion. The casing side wall is disposed along side walls of the plurality of first tubes and the second tube. The first expansion expands from the casing side wall in an outward direction of the casing to provide a first communication chamber therein. The first communication chamber is in communication with the second fluid passages. The casing side wall has an inner surface that is in contact with the side wall of the end first tube such that the second space is separated from the first communication chamber and the second fluid passages.

Accordingly, heat exchange is performed between the first fluid flowing in the first tubes and the second fluid flowing in the second fluid passages provided between the adjacent first tubes. On the other hand, since the second space is separated from the first communication chamber and the second fluid passages, the second fluid does not flow in the second space. Namely, the second space provided on the periphery of the second tube serves as a thermal insulation space, and the heat exchange is not performed in the second tube. Thus, the second tube provides a bypass passage, and the first fluid flowing in the bypass passage does not exchange heat with the second fluid. The second space is separated from the first space without requiring the separation wall.

According to a second aspect of the present invention, a heat exchanger includes a plurality of tubes, a plate member connected to the plurality of tubes, and a joint member to be connected to a second fluid circuit through which a second fluid flows. Each of the tubes defines a first fluid passage therein for allowing the first fluid to flow and includes tube main walls. At least one of the tube main walls of each tube includes a projection and a recess. The projection projects in an outward direction of the tube along a peripheral end of the tube main wall. The recess is disposed on the peripheral end of the tube main wall and is recessed from an end of the projection. The tubes are stacked such that the tube main walls are opposed to each other, spaces are defined between the opposed tube main walls of the adjacent tubes and the projections, and openings are provided by the recesses on side walls of the tubes to be in communication with the spaces. The plate member includes a wall portion and a bulge. The wall portion is disposed along the side walls of the tubes and has an inner surface that closes at least one of the openings such that the space corresponding to the opening closed by the inner surface is closed to provide a thermal insulation space. The bulge expands from the wall portion to define a communication chamber therein. The bulge is defined at a position corresponding to the remaining openings such that the spaces corresponding to the remaining openings are in communication with the communication chamber through the remaining openings and define second fluid passages through which the second fluid flows. The joint member is connected to the bulge and in communication with the communication chamber.

Accordingly, the second fluid flows through the spaces that are in communication with the communication chamber of the bulge. On the other hand, the second fluid does not flows in the thermal insulation space since the opening thereof is closed by the wall portion of the plate member. As such, the space in which heat exchange is not performed is separated from the space in which heat exchange is performed without requiring the separation wall.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXEMPLARY EMBODIMENTS

Figure 1:
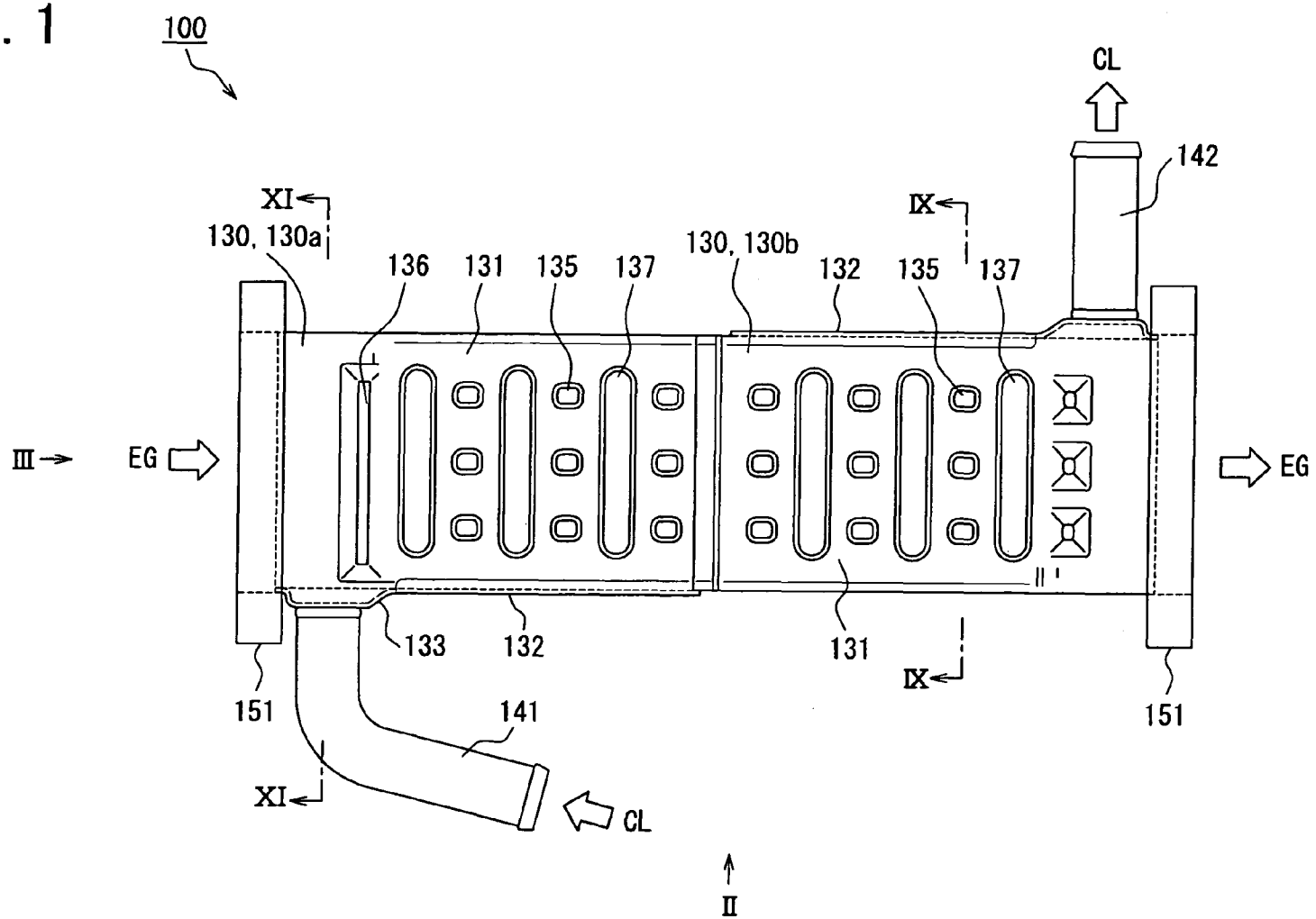
FIG. 1 is a schematic plan view of an EGR gas cooler according to a first embodiment of the present invention.

A first embodiment of the present invention will be described with reference to FIGS. 1 to 11. A heat exchanger 100 shown in FIG. 1 is for example employed as an EGR gas cooler for an exhaust gas recirculation system (EGR system) of a diesel engine.

In the EGR system, an exhaust gas discharged from the engine is partly introduced in a combustion chamber with an intake air. The EGR gas cooler 100 is disposed on an EGR passage that communicates an engine exhaust pipe with an engine intake pipe. The EGR gas cooler 100 generally performs heat exchange between an exhaust gas (e.g., first fluid) to be returned to the intake pipe and an engine coolant (e.g., second fluid), thereby cooling the exhaust gas.

Specifically, the EGR gas cooler 100 has cooling passages C1 through which the exhaust gas flows to be cooled by heat exchange with the engine coolant and bypass passages B1 through which the exhaust gas flows not to be cooled. The volumes of the exhaust gas flowing in the cooling passages C1 and the bypass passages B1 are, for example, controlled by a control valve disposed at an inlet side of the EGR gas cooler 100. That is, since the volume of the exhaust gas passing through the cooling passages C1 and the volume of the exhaust gas passing through the bypass passages B1 are controlled, the temperature of the exhaust gas at an outlet side of the EGR gas cooler 100, that is, the temperature of the EGR gas to be introduced to the intake pipe, can be controlled to a predetermined temperature.

Next, a structure of the EGR gas cooler 100 will be described. In the drawings, arrows CL denote flows of the engine coolant, and arrows EG denote flows of the exhaust gas.

The EGR gas cooler 100 generally includes tubes 110, a casing 130 and connection flanges 151 and the like. Component parts of the EGR gas cooler 100 are made of materials, such as stainless steel, having sufficient resistances to corrosion and heat, because the EGR gas cooler 100 directly contacts the coolant and the exhaust gas. The respective component parts are joined such as by brazing or welding.

As shown in FIGS. 4 to 6, 9 and 11, each of the tubes 110 has a substantially flat tubular shape and defines a gas passage (first fluid passage) 114 therein through which the exhaust gas flows. The tube 110 has a substantially rectangular shape in a cross-section defined in a direction perpendicular to a longitudinal direction of the tube 110. Inner fins 120 are disposed inside of the tubes 110.

For example, each tube 110 is constructed of a first tube plate (first tube member) 110*a* and a second tube plate (second tube member) 110*b*. Each of the first and second tube plates 110*a*, 110*b* is shaped from a flat plate member such as by pressing or rolling to have a generally U-shaped cross-section. Specifically, the tube plate 110*a*, 110*b* has a main wall and side walls on opposite sides of the main wall.

The first and second tube plates 110*a*, 110*b* are joined to each other such that the main walls are opposed to each other and the respective side walls partly overlap with each other. Thus, the gas passage 114 is provided by a space defined between the first and second tube plates 110*a*, 110*b*.

Figure 6:
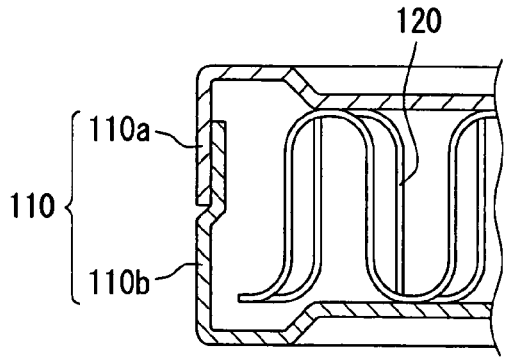
FIG. 6 is a schematic cross-sectional view of a part of the tube as an example, taken along a line VI-VI in FIG. 5B, according to the first embodiment.
Figure 7:
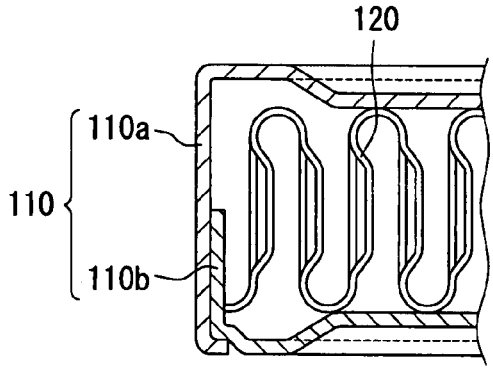
FIG. 7 is a schematic cross-sectional view of a part of the tube as another example, taken along a position corresponding to the line VI-VI in FIG. 5B, according to the first embodiment.

FIG. 6 shows an example of a connecting portion of the first and second tube plates 110*a*, 110*b*. In FIG. 6, the side walls overlap at a substantially middle portion on a side of the tube 110. FIG. 7 shows another example of a connecting portion of the first and second tube plates 110*a*, 110*b*. In FIG. 7, the side walls overlap at a position close to the main wall of the second tube plate 110*b*.

The main wall of each tube plate 110*a*, 110*b* provides a tube main wall (opposed wall) 111. The tube main wall corresponds to a flat wall of the flat tube 110. That is, the tube main wall correspond to a longitudinal side in the rectangular-shaped cross-section. The joined side walls of the tube plate 110*a*, 110*b* provide tube side walls 118. The tube side walls 118 correspond to longitudinal sides of the tube 110. That is, the side walls 118 correspond to short sides in the rectangular-shaped cross-section.

The inner fin 120 is for example a corrugated fin, which is formed from a thin plate member by pressing. The inner fin 120 is located between the first and second tube plates 110*a*, 110*b* and joined to inner surfaces of the tube main walls 111 such as by brazing. In manufacturing, for example, the inner fins 120 are interposed between the first and second tube plates 110*a*, 110*b*, and the first and second tube plates 110*a*, 110*b* are brazed in this condition. Therefore, the inner fins 120 are brazed with the first and second tube plates 110*a*, 110*b* at the same time as brazing the first and second tube plates 110*a*, 110*b*.

Figure 4:
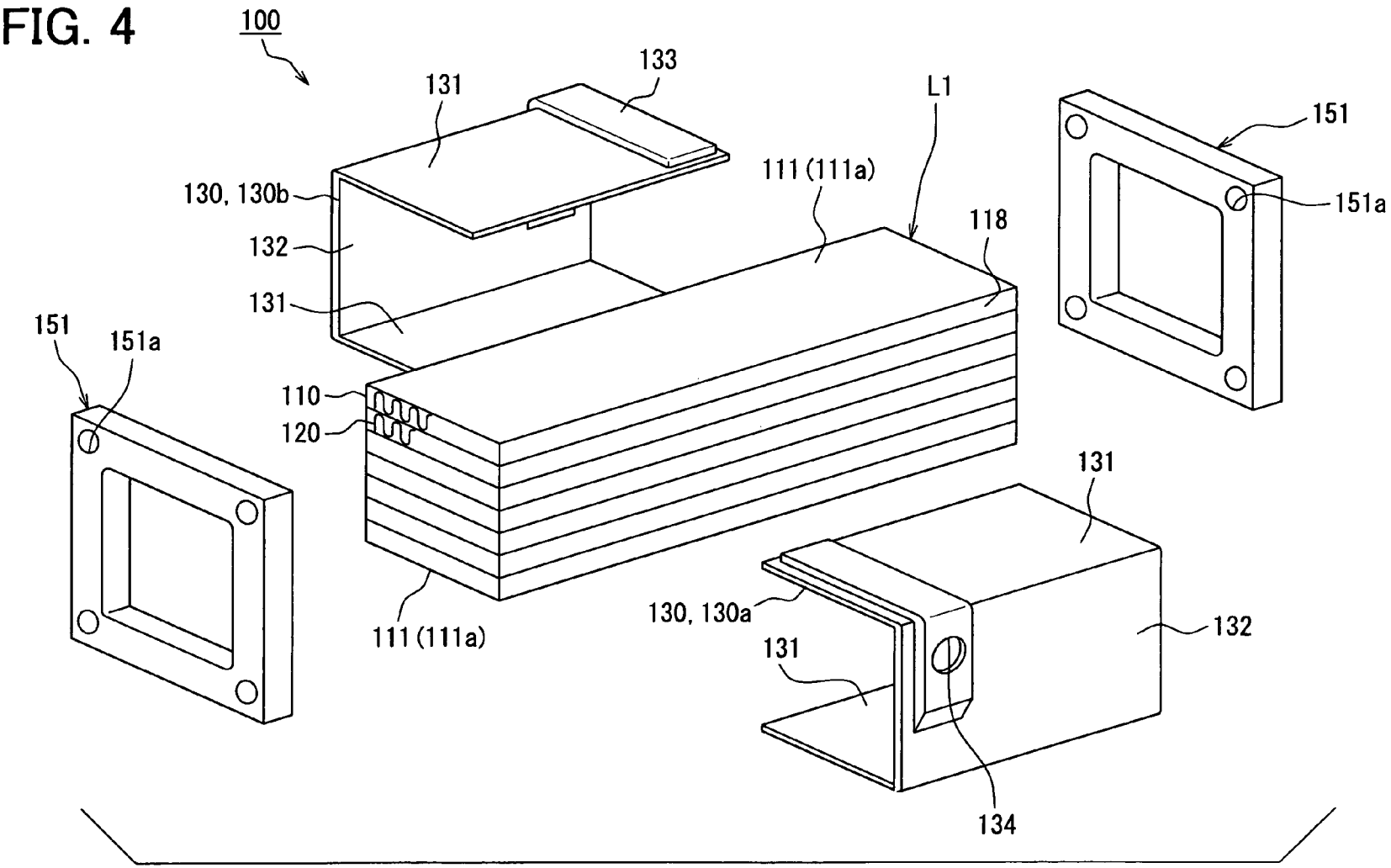
FIG. 4 is an exploded perspective view of the EGR gas cooler according to the first embodiment.
Figure 8:
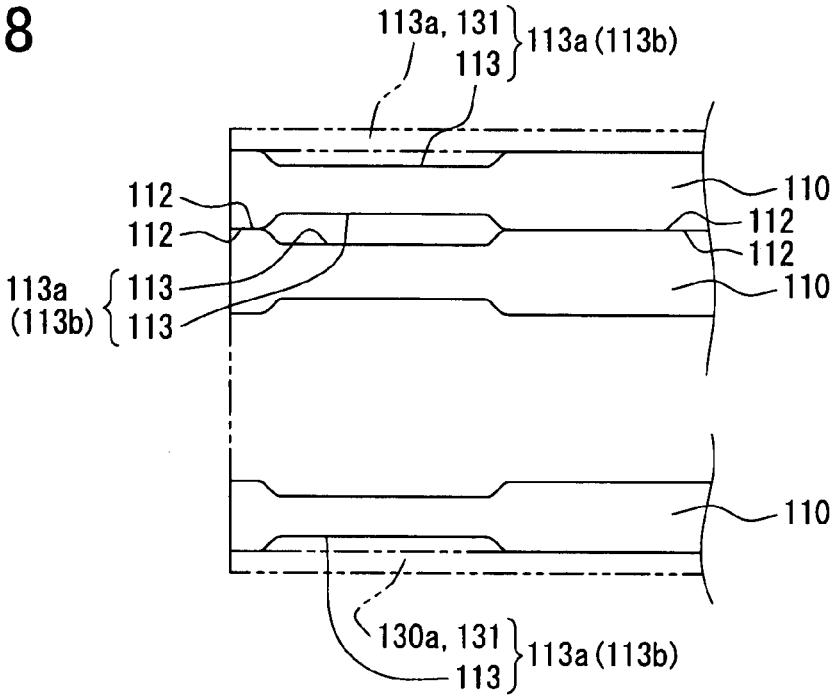
FIG. 8 is a schematic side view of a stack of tubes of the EGR gas cooler according to the first embodiment.
Figure 9:
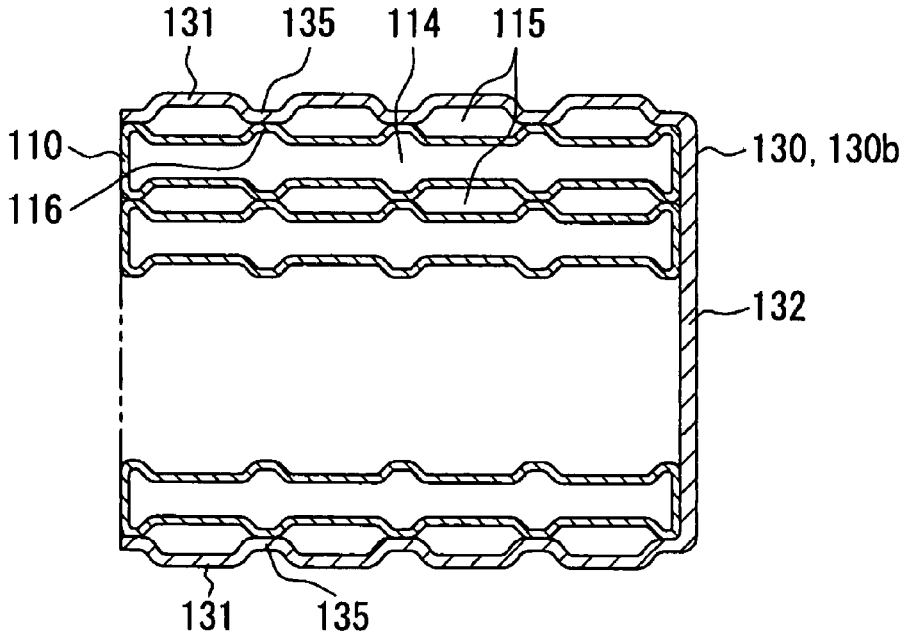
FIG. 9 is a schematic cross-sectional view of the EGR gas cooler taken along a line IX-IX in FIG. 1.

The tubes 110 are stacked or layered such that the tube main walls 111 are opposed to each other, as shown in FIGS. 4, 8 and 9. Spaces are provided between the tube main walls 111 of the adjacent tubes 110. Coolant passages (second fluid passages) 115 through which the coolant flows are provided by the spaces between the adjacent tubes 110. The gas passages 114 are formed inside of the tubes 110. The main walls 111 of outermost tubes 110, which are disposed on outermost layers of the stack of the tubes 110, provide outermost tube walls 111*a*.

Figures 5A, 5B, 5C:
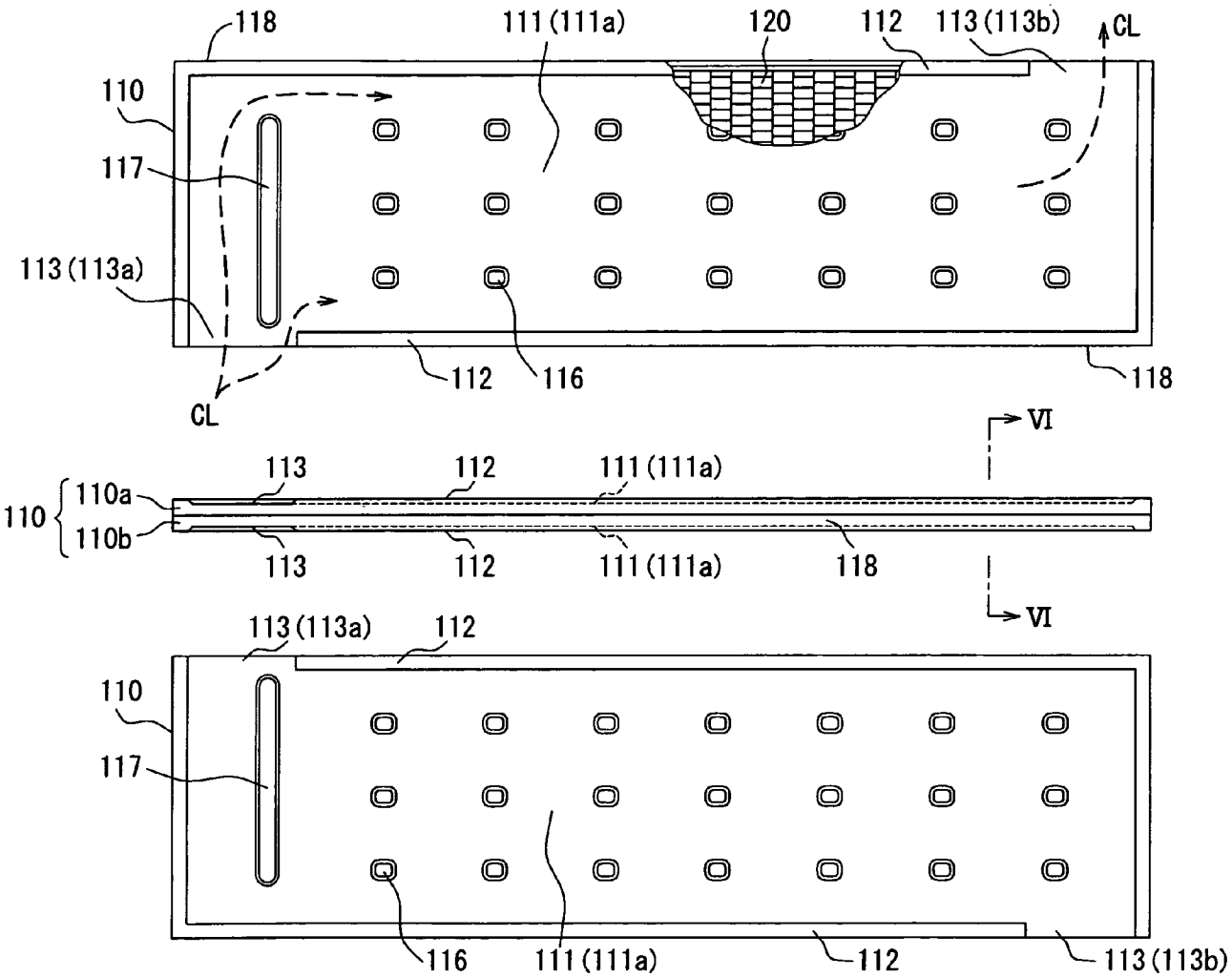
FIG. 5A is a top view of a tube of the EGR gas cooler according to the first embodiment.
FIG. 5B is a side view of the tube according to the first embodiment.
FIG. 5C is a bottom view of the tube according to the first embodiment.

Each of the tubes 110 has projections 112 and recesses 113 on both tube main walls 111 thereof, as shown in FIGS. 5A to 5C. The projections 112 are for example formed by pressing at the same time as forming the first and second tube plates 110*a*, 110*b*. In the present embodiment, all the tubes 110 have the same shape and structure. Thus, the outermost tubes 110 also have the projections 112 and the recesses 113 on the outermost tube walls 111*a*, as shown in FIG. 4.

The projection 112 projects from the tube main wall 111 in an outward direction of the tube 110. The projection 112 is for example formed by pressing. The projection 112 is formed along a peripheral end of the tube main wall 111 like a continuous dam or bank.

The recesses 113 are partly formed on the peripheral end of the tube main wall 111, and are recessed from a top end of the projection 112 toward the tube main wall 111. Each recess 113 has a predetermined length in a longitudinal direction of the tube main wall 111. In the present embodiment, the depth of the recess 113 is for example equal to the height of the projection 112 with respect to a direction perpendicular to the tube main wall 111. Namely, a bottom surface of the recess 113 is coplanar with the tube main wall 111.

For example, the projections 112 are not entirely formed along the peripheral end of the tube 110, but partly formed along the peripheral end of the tube 110 so that the recesses 113 are provided by the portions where the projections 112 are not formed. Here, two recesses 113 are formed on each tube main wall 111. Also, the two recesses 113 are located on diagonal positions and along longitudinal sides of the tube main wall 111.

Thus, when the tubes 110 are layered, spaces are provided between the tube main walls 111 of the adjacent tubes 110 and the projections 112 as the coolant passages 115, as shown in FIG. 9. Also, openings 113*a*, 113*b* are formed by the opposed recesses 113 of the adjacent tubes 110 to allow the spaces of the coolant passages 115 to communicate with outside of the stack of tubes 110. Namely, the coolant passages 115 are in communication with the outside of the stack of tubes 110 only through the openings. The openings 113*a*, 113*b* serve as coolant inlets 113*a* and coolant outlets 113*b* for introducing and discharging the coolant into and from the coolant passages 115.

Since the recesses 113 are formed along the longitudinal sides of the tube main walls 11, that is, along the tube side walls 118, the coolant passages 115 are closed at the longitudinal ends of the tubes 110. In this case, core plates, which are generally used to maintain the tubes at predetermined intervals in order to provide the spaces between the adjacent tubes, are not required.

Further, the tube 110 has first raised portions 116 on both tube main walls 111 thereof. The first raised portions 116 are arranged at predetermined intervals over the tube main wall 111. Each raised portion 116 projects outwardly from the tube main wall 111 in a form of tube or cylinder and has the same dimension (height) as the projection 112 in a direction perpendicular to the tube main wall 111.

The tube 110 further has second raised portions 117 on both tube main walls 111 thereof as flow-adjusting portions for adjusting or arranging the flow of the coolant. Each second raised portion 117 is located adjacent to one of the recesses 113, such as the recess 113 that is located adjacent to an upstream end of the tube 110 with respect to the flow of the exhaust gas. Also, the second raised portion 117 is located closer to the recess 113 that forms the coolant inlet 113*a*.

In the example shown in FIGS. 5A and 5C, the second raised portion 117 is located closer to a left recess 113. Also, the second raised portion 117 is located closer to the end that forms an inlet of the gas passage 114.

The second raised portion 117 extends parallel to a short side of the tube main wall 111, i.e., extends perpendicular to a longitudinal direction of the tube 110. The second raised portion 117 has the same height as the projection 112. Since the second raised portion 117 is formed adjacent to the coolant inlet 113*a*, the coolant flows in the coolant passage 115, as shown by dashed line CL in FIG. 5A. By the second raised portion 117, the coolant is introduced in the coolant passage 115 such that the coolant is uniformly distributed over the tube main wall 111. Therefore, efficiency of heat exchange between the coolant and the exhaust gas improves.

As shown in FIG. 4, the tubes 110 having the above structure are stacked such that the tube main walls 111 are opposed to each other and the respective projections 112 are opposed to and in contact with each other. As such, the tubes 110 are joined to each other at the projections 112. Hereafter, the stack of tubes 110 is referred to as the tube stack body L1.

Since the first raised portions 116 and the second raised portion 117 have the same height as the projection 112, the adjacent tubes 110 are also in contact with and are joined at the first raised portions 116 and the second raised portion 117.

Further, the inner fins 120 are joined to the inner surfaces of the tubes 110. Accordingly, the strength of the tube stack body L1 improves.

Figure 12:
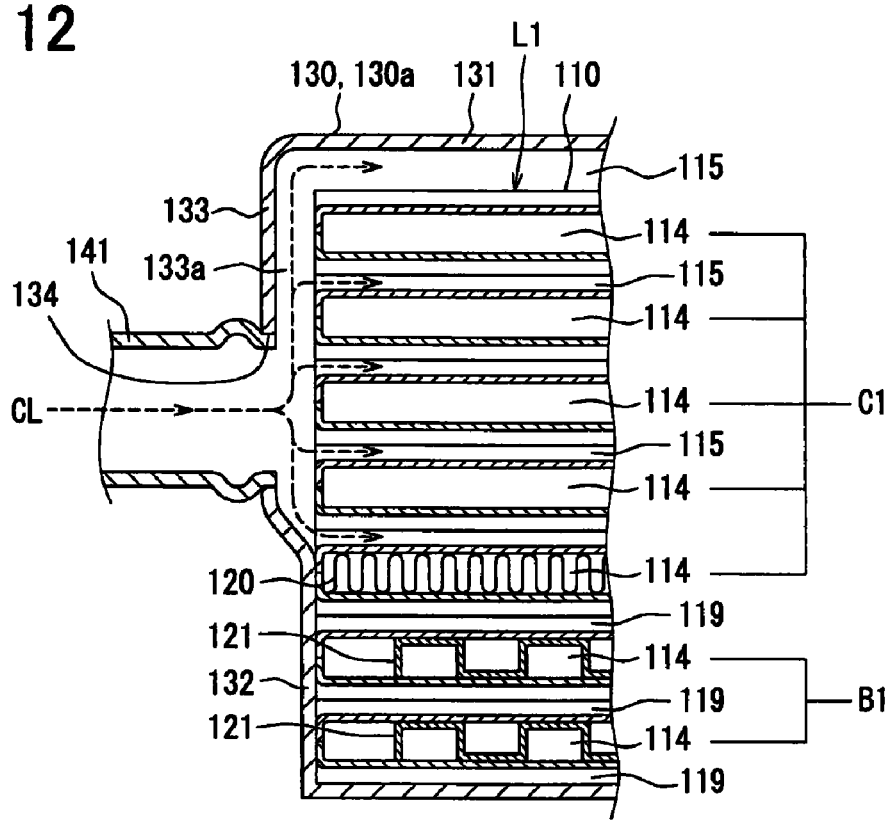
FIG. 12 is a schematic cross-sectional view of an EGR gas cooler, taken at a position corresponding to the line XI-XI in FIG. 1, as an example, according to a second embodiment of the present invention.

In the tube stack body L1, the spaces are provided between the adjacent tubes since the projections 112 are formed on the tube main walls 111. Each space is surrounded by the projections 112. The coolant passage 115 is defined by this space except for the first raised portions 116 and the second raised portions 117, as shown in FIGS. 9 and 12.

Further, the each coolant passages 115 has two openings 113*a*, 113*b*, each of which is provided by the opposed recesses 113 of the adjacent tubes 110. Here, one of the openings 113*a*, 113*b* is the coolant inlet for introducing the coolant into the coolant passage 115, and the other is the coolant outlet for discharging the coolant from the coolant passage 115. In the present embodiment, the opening 113*a* that is adjacent to the second raised portions 117 is the coolant inlet, and the opening 113*b* that is farther away than the opening 113*a* with respect to the second raised portion 117 is the coolant outlet.

The casing 130 is disposed to surround the tube stack body L1, as shown in FIG. 4. The casing 130 is joined to all of the tubes 110. For example, the casing 130 includes a first casing member 130*a* and a second casing member 130*b*, which are aligned in a longitudinal direction of the tube stack body L1. The first casing member 130*a* is disposed adjacent to the coolant inlet 113*a* of the tube sack body L1, and the second casing member 130*b* is disposed adjacent to the coolant outlet 113*b* of the tube stack body L1.

Each of the first and second casing members 130*a*, 130*b* has a substantially U-shape and includes casing outer walls 131 and a connecting wall (plate member) 132 between the outer walls 131. The outer walls 131 are parallel to each other, for example. The first and second casing members 130*a*, 130*b* are formed from plate members by bending, for example.

The first and second casing members 130*a*, 130*b* are coupled to the tube stack body L1 such that the outer walls 131 are opposed to the outermost tube walls 111*a* and the connecting walls 132 are opposed to the tube side walls 118. Further, the first and second casing members 130*a*, 130*b* are joined to the tube stack body L1 such that the connecting walls 132 are in contact with the tube side walls 118 and cover the coolant inlet and outlets 130*a*, 130*b*.

In this case, since the coolant inlets 113*a* and the coolant outlets 113*b* are located on diagonal positions of the tube stack body L1, the first and second casing members 130*a*, 130*b* are coupled from opposite sides of the tube stack body L1. Specifically, the connecting portion 132 of the first casing member 130*a* are opposed to the coolant inlets 113*a*, and the connecting portion 132 of the second casing member 130*b* are opposed to the coolant outlets 113*b*.

Figure 10:
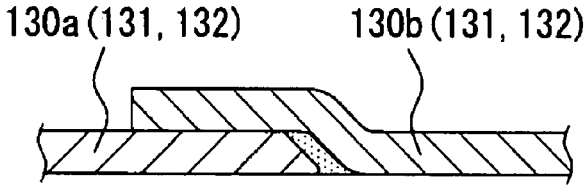
FIG. 10 is a partial cross-sectional view of a connecting portion of casing members of a casing of the EGR gas cooler according to the first embodiment.

Further, as shown in FIG. 1, ends of the first and second casing members 130*a*, 130*b* are engaged and joined with each other at a position corresponding to a substantially middle portion of the tube stack body L1 in the longitudinal direction. For example, the ends of the first and second casing members 130*a*, 130*b* overlap with each other, as shown in FIG. 10.

Although the first and second casing members 130*a*, 130*b* are coupled to the tube stack body L1 in opposite directions and at different positions, these have the similar structure. Thus, the structure of the first and second casing members 130*a*, 130*b* will be hereafter described in detail based on the structure of the first casing member 130*a* as an example.

Figure 2:
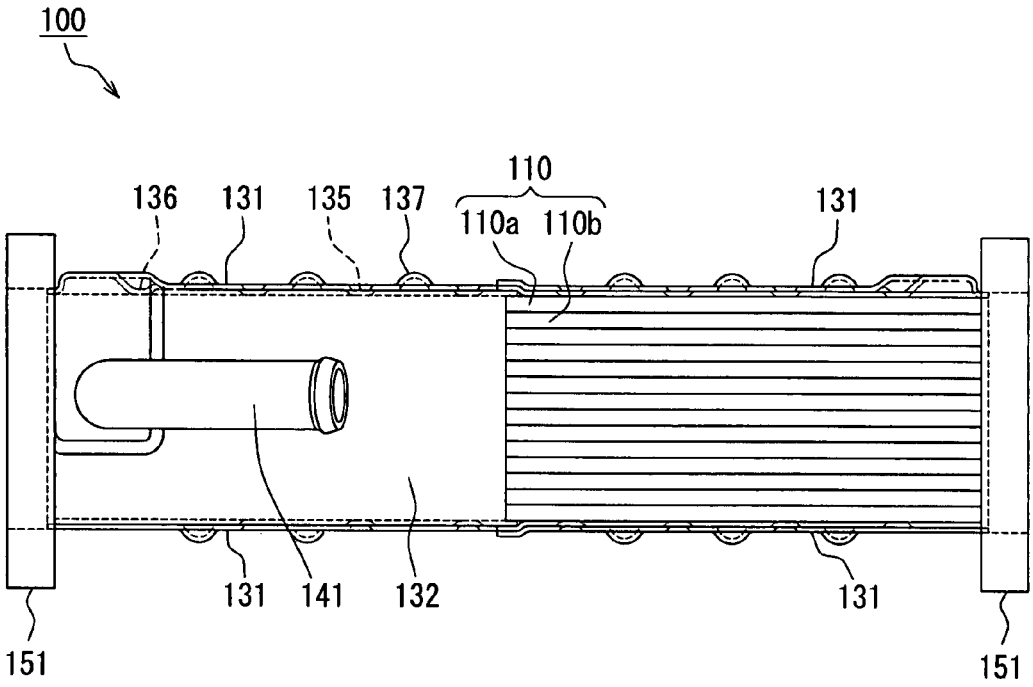
FIG. 2 is a schematic side view of the EGR gas cooler, when viewed along an arrow II in FIG. 1.

As shown in FIGS. 1, 2 and 9, a peripheral end of each outer wall 131 is in contact with and joined to the projection 112 of the outermost tube wall 111*a*. A main portion of each outer wall 131, other than the peripheral end, is raised from the peripheral end in an outward direction of the U-shaped casing member 130*a*. Further, first recesses 135, a second recess 136, and reinforcement ribs 137 are formed on the raised main portion of each outer wall 131.

The first recesses 135 are recessed from the raised main portion in an inward direction of the U-shaped casing member 130*a* so as to be in contact with and joined to the first raised portions 116 of the outermost tube wall 111*a*. The second recess 136 is recessed from the raised main portion in the inward direction of the U-shaped casing member 130*a* so as to be in contact with and joined to the second raised portion 117 of the outermost tube wall 111*a*, as the flow-adjusting portion. The reinforcement ribs 137 are located between the first recesses 135 and project from the raised main wall in the outward direction of the U-shaped casing member 130*a*, as shown in FIG. 2. The reinforcement ribs 137 are formed to improve strength of the outer walls 131.

Figure 11:
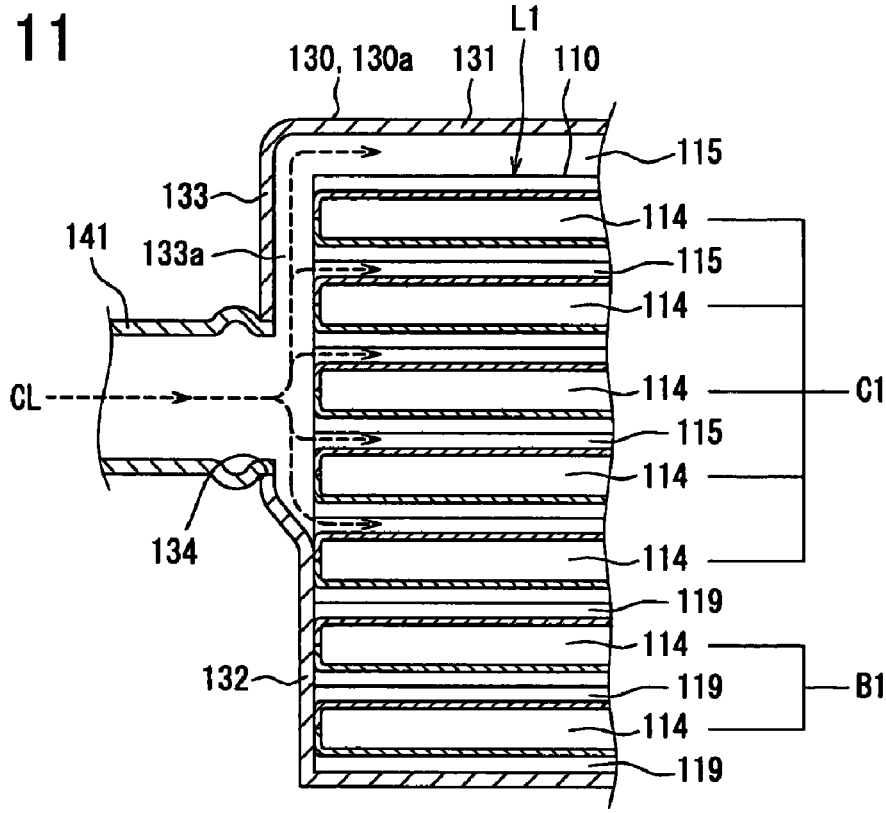
FIG. 11 is a cross-sectional view of the EGR gas cooler taken along a line XI-XI in FIG. 1.

As shown in FIGS. 9 and 11, a space is provided between one outer wall 131 and the outermost tube wall 111*a*. The space is surrounded by the peripheral end of the outer wall 131 and the projection 112 of the outermost tube wall 111*a*. Similar to the coolant passages 115 provided between the adjacent tubes 110, an end coolant passage 115 is provided by this space, except for the first raised portions 116, the first recesses 135 and the second raised portion 117 and the second recess 136.

Further, as shown in FIG. 8, an end opening 113*a* is formed between the outer wall 131 and the recess 113 of the outermost tube 110 as the coolant inlet for introducing the coolant into the end coolant passage 115. Likewise, the end opening 113*b* is formed between the outer wall 131 and the other recess 113 of the outermost tube 110 as the coolant outlet for discharging the coolant from the end coolant passage 115.

The connecting wall 132 of the first casing member 130*a* is in contact with and joined to the side walls 118 on which the coolant inlets 113*a* are formed. Likewise, the connecting wall 132 of the second casing member 130*b* is in contact with and joined to the side walls 118 on which the coolant outlets 113*a*, 113*c* are formed.

The first casing member 130*a* is also formed with a bulge 133 at a position corresponding to the coolant inlets 133*a*. In the example shown in FIG. 11, the bulge 133 is formed at a position corresponding to predetermined coolant inlets 133*a* other than the lower three coolant inlets 133*a*. The bulge 133 expands in an outward direction of the U-shaped first casing member 130*a* and provides a clearance (communication chamber) 133*a* between an inner surface thereof and the side walls 118 of the tubes 110. In FIG. 11, illustration of the inner fins 120 is omitted.

On the other hand, the lower three coolant inlets 133*a* are closed by the inner surface of the connecting wall 132. Likewise, the second casing member 130*b* has a bulge 133 at a position corresponding to predetermined coolant outlets 133*b* other than the lower three coolant outlets 133*a*. The lower three coolant outlets 133*a* are closed by an inner surface of the connecting wall 132 of the second casing member 130*b*.

As such, the spaces provided between the lower three tubes 110 and the lower outer wall 131 are closed, and the coolant does not flow in the spaces. Instead, the closed spaces are filled with air, thereby to provide thermal insulation spaces 119.

In other words, the lower two tubes 110 are surrounded by the thermal insulation spaces 119. Therefore, the decrease in temperature of the exhaust gas passing through the gas passages 114 of the lower two tubes 110 is restricted. Accordingly, the gas passages 114 of the lower two tubes 110 provide the bypass passages B1.

On the other hand, the other tubes (e.g., upper five tubes in FIG. 11) 110 are surrounded by the coolant passages 115. Therefore, heat exchange is performed between the coolant and the exhaust gas passing through the gas passages 114 of the other tubes 110. As a result, the temperature of the exhaust gas is reduced. Accordingly, the gas passages 114 of the other tubes 110 correspond to the cooling passages C1. The tube 110 that is located adjacent to the tube 110 that forms the bypass passage B1, that is, a fifth tube 110 from the top in FIG. 11, faces both of the cooling passage 115 and the thermal insulation space 119.

In the first casing member 130*a*, the bulge 133 extends over one of the outer walls 131, which is on a side opposite to the bypass passages B1, that is, the upper outer wall 131 in FIG. 4. Thus, the end coolant passages 115 that is provided between the outermost tube wall 111*a* and the upper outer wall 131 is partly expanded. The bulge 133 has an opening 134 to which a coolant inlet pipe 141 as a joint member is coupled. In the second casing 130*b*, the bulge 133 has an opening, and a coolant outlet pipe 142 as a joint member is coupled to the opening.

As such, the coolant inlet pipe 141 is in communication with the coolant outlet pipe 142 through the clearance 133*a* of the first casing member 130*a*, the coolant inlets 113*a*, the coolant passages 115, the coolant outlets 113*b* and the clearance 133*b* of the second casing member 130*b*. When the coolant inlet pipe 141 and the coolant outlet pipe 142 are coupled to an engine coolant circuit, the coolant can flow through the coolant passages 115.

On the other hand, the exhaust gas generally passes through the gas passages 114 in the longitudinal direction of the tube stack body L1. The connection flanges 151 are joined to the longitudinal ends of the tube stack body L1. The EGR gas cooler 100 is connected to the EGR passage (not shown), which connects the exhaust pipe to the intake pipe, through the flanges.

Figure 3:
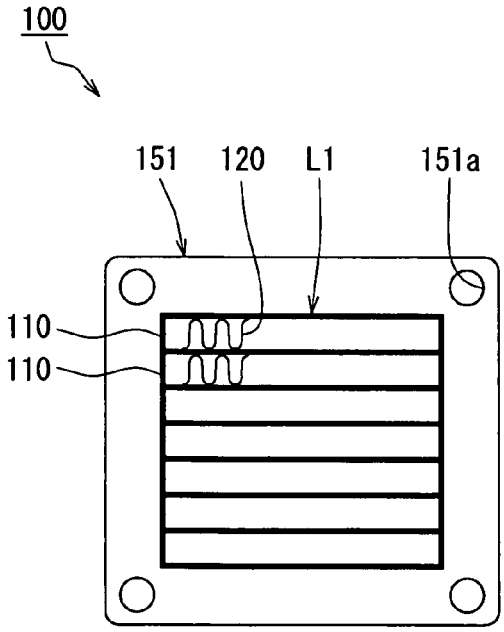
FIG. 3 is a schematic end view of the EGR gas cooler, when viewed along an arrow III in FIG. 1.

As shown in FIG. 3, each of the connection flanges 151 has a substantially rectangular or square shape, and through holes 151*a* as fixing holes are formed on the corners of the connection flanges 151. Fixing members such as bolts are inserted to the through holes 151*a* for connecting and fixing the EGR gas cooler 100 to the EGR passages.

As shown by the arrows EG in FIG. 1, the exhaust gas flows in the gas passages 114 from one of the ends, such as the left end in FIG. 1. The exhaust gas passes through the gas passages 114 in the longitudinal direction of the gas cooler EGR 100, and flows out from the other end, such as the right end in FIG. 1.

On the other hand, as shown by the arrows CL in FIG. 1, the coolant flows in the EGR gas cooler 100 from the coolant inlet pipe 141. The coolant flows in the coolant passages 115 through the clearance 133*a* and the coolant inlets 113*a* that are not closed by the connecting wall 132 of the first casing member 130*a* and flows out from the coolant passages 115 through the coolant outlets 113*b* that are not closed by the connecting wall 132 of the second casing member 130*b*. Then, the coolant flows out from the EGR gas cooler 100 from the coolant outlet pipe 132.

Regarding the tubes 110 that provide the cooling passages C1, the coolant passages 115 are formed on at least one of the sides thereof, as shown in FIG. 11. Therefore, the heat exchange is performed between the exhaust gas passing through the gas passages 114 and the coolant passing through the coolant passages 115, and hence the exhaust gas is cooled.

On the other hand, in the tubes 110 that provide the bypass passages B1, the air-filled thermal insulation spaces 119 are formed on both sides thereof, as shown in FIG. 11. Therefore, the temperature of the exhaust gas passing through the bypass passages B1 hardly reduces.

In the present embodiment, the coolant passages 115 are formed by communicating the coolant inlets and outlets 113*a*, 113*b* of the predetermined tubes 110 with the clearances 133*a* of the bulges 133. The thermal insulation spaces 119 are formed by closing the coolant inlets and outlets 113*a*, 113*b* of the other tubes 110 with the inner surface of the connecting wall 132 of the casing 130. Here, the cooling passages C1 and the bypass passages B1 are separated from each other without requiring a separation wall between them. In other words, the cooling passages C1 and the bypass passages B1 are separated by devising the shape of the casing 130, that is, by the configuration of the bulge 133. Since the separation wall is not required, a step of assembling and joining the separation wall to the casing is not necessary. Therefore, manufacturing costs of the EGR gas cooler 100 reduces.

The projections 112 and the recesses 113 are formed on the tube main walls 111, and the tubes 110 are stacked such that the projections 112 are in contact with each other. Thus, the coolant passages 115 are provided by the spaces provided between the adjacent tubes 110 and surrounded by the projections 112. In this case, the coolant passages 115 are airtightly formed by joining the projections 112. The gas passages 114 and the coolant passages 115 are separated from each other without using the core plates. In other words, the spaces for the coolant passages 115 and the thermal insulation spaces 119 are provided between the adjacent tubes 110 without using the core plates. Since the core plates are not necessary, a step of inserting the ends of the tubes 110 to holes of the core plates is reduced. As a result, the manufacturing costs of the EGR gas cooler 100 further reduces.

In the present embodiment, the dimension (depth) of the recesses 113 is equal to the height of the projections 112. Therefore, the size of the coolant inlets and outlets 113*a*, 113*b* is increased. Accordingly, resistance of the coolant to flow in and out of the water passages 115 reduces.

Also, the coolant inlets 113*a* and the coolant outlets 113*b* are located on diagonal positions of the tube main walls 111. Therefore, a region where the coolant easily stagnate is reduced. Namely, it is less likely that the coolant will stagnate in the water passage 115. Accordingly, heat exchange efficiency improves.

Further, the second raised portions 117 are formed on the tube main walls 111 as the flow-adjusting portions. Therefore, the coolant entering from the coolant inlets 113*a* can be substantially uniformly distributed over the coolant passages 115. Namely, the heat exchange between the coolant and the exhaust gas is effectively performed over the tube main walls 111. Accordingly, the heat exchange efficiency further improves.

In a case that the coolant stagnates in the water passage 115 at a position corresponding to a portion where the high temperature exhaust gas flows, heat exchange is excessively performed, resulting in boiling of the coolant. In the present embodiment, however, the second raised portions 117 are located at upstream ends of the tube main walls 111 with respect to the flow of the exhaust gas. Therefore, it is less likely that the coolant will boil due to the excess heat exchange.

In the present embodiment, each tube 110 is constructed by joining the first and second tube plates 110*a*, 110*b*. The first and second tube plates 110*a*, 110*b* are formed such as by bending, pressing, rolling and the like. Therefore, the tubes 110 are produced easily and with reduced costs, as compared with a case in which a tube is formed by shaping a cylindrical tube member into a flat tubular shape.

Since the inner fins 120 are provided in the gas passages 114 of the tubes 110, turbulence effect is provided to the flow of the exhaust gas. As such, the heat exchange efficiency improves.

The projections 112 and the recesses 113 are also formed on the outermost tube walls 111*a* of the outermost tubes 110, and the outer walls 131 of the casing members 130*a*, 130*b* are joined to the projections 112 of the outermost tube walls 111*a*. Therefore, the end coolant passages 115 having the end coolant inlets 130*a* and the end coolant outlets 130*b* are formed between the outermost tube walls 111*a* and the outer walls 131. Because the heat exchange area increases, the heat exchange efficiency improves.

In each casing members 130*a*, 130*b*, the outer walls 131 are connected through the connecting wall 132. Namely, the outer walls 131 are integrally formed into the casing member 130*a*, 130*b*. Therefore, the casing members 130*a*, 130*b* are easily coupled to the tube stack body L1 by inserting the tube stack body L1 into the space defined between the outer walls 131.

The connecting walls 132 of the first and second casing members 130*a*, 130*b* are opposed to and joined to the side walls 118 of the tubes 110. The bulges 133 are formed on the connecting walls 132 at positions corresponding to the coolant inlet and outlets 113*a*, 113*b* such that the predetermined clearances 133*a* are provided between the inner surfaces of the bulges 133 and the coolant inlets and outlets 113*a*, 113*b*. Further, the coolant inlet pipe 141 and the coolant outlet pipe 142 are coupled to the pipe holes 134 formed on the bulges 133.

With this configuration, expansion loss or reduction loss while the coolant flows into and out of the coolant passages 115 reduces. That is, because pressure loss of the flow of the coolant reduces, the heat exchange efficiency improves.

In the present embodiment, the coolant inlets and outlets 113*a*, 113*b* of the predetermined tubes 110 are closed by the connecting walls 132 of the casing 130 so that the thermal insulation spaces 119 are formed. The exhaust gas passing through the gas passages 114 of the tubes 110 that are located between the thermal insulation spaces 119 does not exchange heat with the coolant. Therefore, the temperature of the gas cooler will be substantially maintained. The tubes 110 that are located between the thermal insulation spaces 119 provide the bypass passages B1.

In other words, the bypass passages B1 are easily formed by simply closing the coolant inlet and outlets 113*a*, 113*b* of the predetermined tubes 110 with the inner surfaces of the connecting walls 132 of the casing 130. Therefore, the number of component parts of the EGR gas cooler 100 reduces, and the assembling steps reduces, as compared with an EGR gas cooler having the separation wall for fluid-tightly separating the inside of the casing into two spaces.

In the illustrated example, the tube stack body L1 has seven tubes 110. However, the number of the tubes 110 is not limited, but may be two or more. Also, the number of the tubes 110 providing the bypass passages B1 is not limited to two. The EGR gas cooler 100 has at least one tube 10 for the bypass passages B1.

In the present embodiment, all the tubes 110 have the inner fins 120. However, the inner fins 120 of the tubes 110 for the bypass passages B1 may be eliminated or modified.

Second Embodiment

Figure 13:
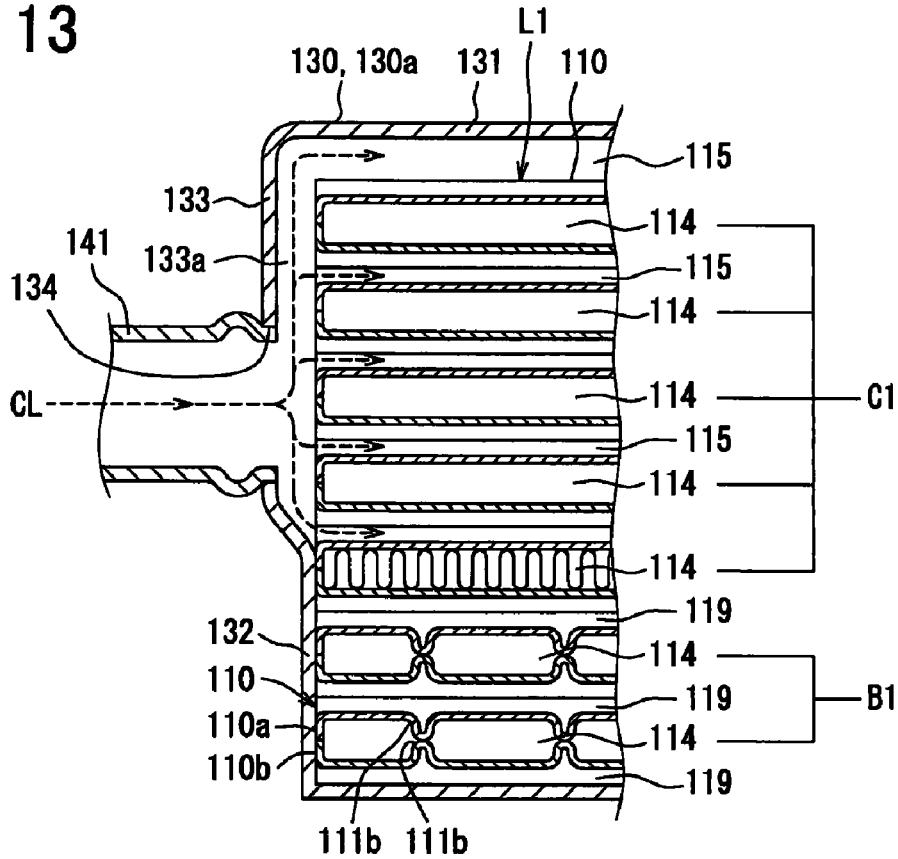
FIG. 13 is a schematic cross-sectional view of the EGR gas cooler, taken at a position corresponding to the line XI-XI in FIG. 1, as another example, according to the second embodiment.

A second embodiment will be described with reference to FIGS. 12 and 13. In the EGR gas cooler 100 of the second embodiment, the tubes 110 that provide the bypass passages B1 have spacers (space maintaining members) 121, in place of the inner fins 120.

In an example shown in FIG. 12, the spacers 121 are disposed in the gas passages 114 of the lower two tubes 110. The spacers 121 are made of a material similar to those of the component parts of the tubes 110, such as stainless steel.

In the manufacturing process of the tube stack body L1, for example, the tubes 110 are brazed in a furnace in a condition that the stacked tubes 110 are pressed in a tube stacking direction, such as an up and down direction of FIG. 12, by a jig. At this time, a pressing force of the jig will be exerted to deform the tube plates 110*a*, 110*b*. In the case where the inner fins 120 are interposed between the tubes plates 110*a*, 110*b*, the inner fins 120 serve as reinforcement members having resistance against the pressing force of the jig. Therefore, the deformation of the tube plates 10*a*, 110*b* is restricted.

Although the inner fins 120 provide the effect of improving the heat exchange efficiency between the exhaust gas and the coolant, the resistance to flow of the gas passages 114 will be increased. In the tubes 110 of the bypass passages B1, heat exchange between the exhaust gas and the coolant is not performed. Therefore, the inner fins 120 are not always necessary. Also, in view of the reduction of the resistance to flow of the gas passages 114, the inner fins 120 are not always necessary.

In the second embodiment, therefore, the spacers 121 are configured such that the deformation of the tube plates 110*a*, 110*b* in the process of forming the tube stack body L1 is restricted and the resistance to flow of the gas passages 114 is reduced smaller than that of the gas passages 114 having the inner fins 120. For example, the spacers 121 are made of plates having a thickness smaller than that of a member of the inner fins 120 while having high rigidity. Also, each spacer 121 is formed such that an area thereof is smaller than that of the inner fin 120 when projected in the flow direction of the exhaust gas of the gas passage 114.

As such, the EGR gas cooler 100 that is capable of reducing the deformation of the tube plates 110*a*, 110*b* during the manufacturing and reducing the resistance to flow of the gas passages 114 is provided.

As the spacers 121, inner fins having pitches larger than those of the inner fins 120 may be employed. In the example shown in FIG. 12, the spacers 121 are disposed in the tubes 110 as members separate from the tubes 110. Alternatively, the spacers 121 can be integrally formed with the tubes 110. For example, in FIG. 13, projections 111*b* are formed on the tube plates 110*a*, 110*b*, and the tube plates 110*a*, 110*b* are disposed such that the projections 111*b* project inwardly and are joined with each other as the spacers. In this case, the number of components parts and the number of assembling steps will be reduced.

Third Embodiment

Figure 14:
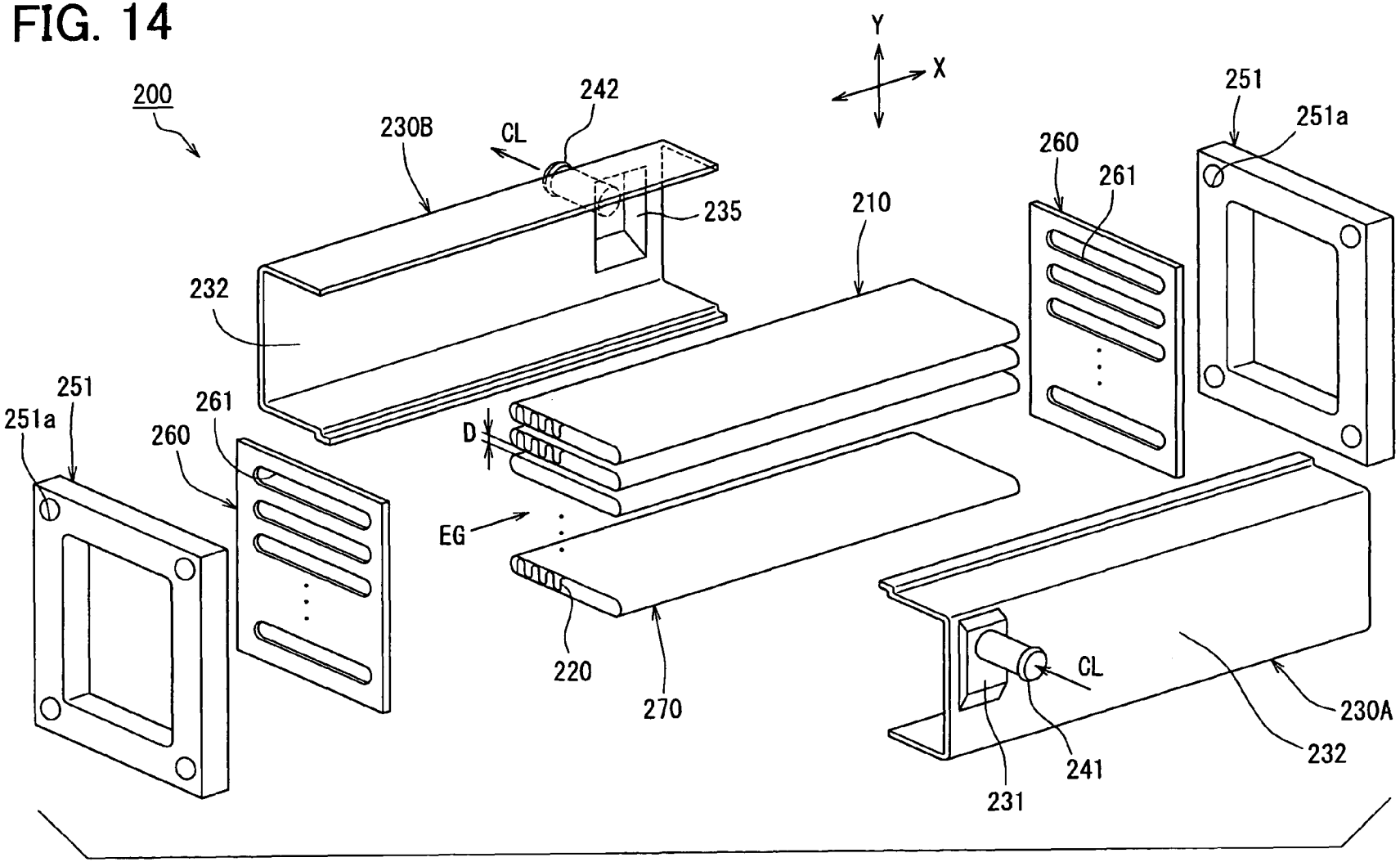
FIG. 14 is an exploded perspective view of an EGR gas cooler according to a third embodiment of the present invention.

A third embodiment will be described with reference to FIGS. 14 and 15. In an EGR gas cooler 200 of the third embodiment, shapes of the tubes and casing are different from those of the EGR gas cooler 100 of the first embodiment. As shown in FIG. 14, the EGR gas cooler 200 has first tubes 210 and second tubes 270 both having simple flat tubular shapes and a casing 230 having a substantially tubular shape. Hereafter, a structure of the EGR gas cooler 200 will be described.

Because the EGR gas cooler 200 directly contacts the exhaust gas and the coolant, component parts of the EGR gas cooler 200 are made of a material having resistance to corrosion and resistance to high temperature, such as stainless steel, similar to the first embodiment. Further, the component parts are joined to each other such as by brazing or welding.

In FIG. 14, an arrow X denotes a longitudinal direction of the first tubes 210, and an arrow Y denotes a direction in which the first tubes 210 are sacked or layered. The first tubes 210 have inner fins 220 therein. The first tubes 210 are stacked while maintaining predetermined clearances D between them. Also, both ends of the first tubes 210 are joined to core plates 260. Thus, the first tubes 210 forms a first tube group A1 as shown in FIG. 15.

The core plates 260 are formed with openings 261. The first tubes 210 are joined to and fixed to the core plates 260 in a condition that the ends of the tubes 210 are engaged with the openings 261.

Figure 15:
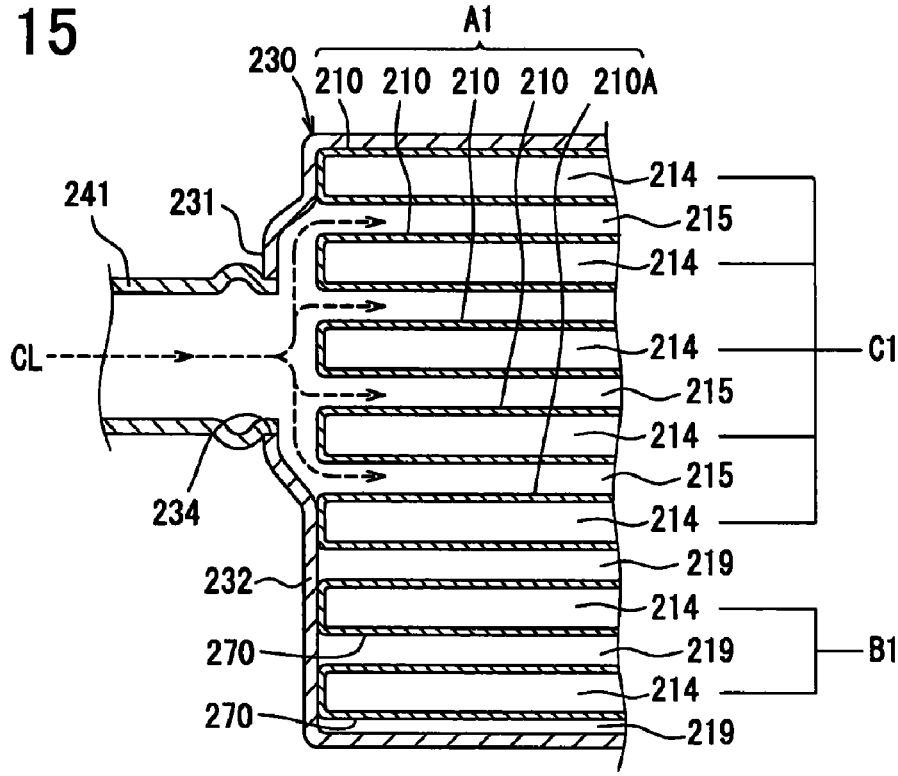
FIG. 15 is a schematic cross-sectional view of the EGR gas cooler, taken at a position corresponding to the line XI-XI in FIG. 1, according to the third embodiment.

The second tubes 270 are disposed along an outermost first tube 110A, which is disposed on an outermost layer of the stack of the first tubes 110 in the tube stack direction Y, such as a lower first tube 110A in FIG. 15. The first tubes 110 including the outermost first tube 110A provide the cooling passages C1 that perform heat exchange between the exhaust gas flowing therein and the coolant.

On the other hand, the second tubes 270 provide the bypass passages B1 that does not perform heat exchange between the exhaust gas and the coolant for restricting the decrease in temperature of the exhaust gas. The second tubes 270 are also joined to and fixed to the core plates 260 in a condition that the ends of the second tubes 270 are engaged with the openings 261 of the core plates 260.

As shown in FIG. 14, connection flanges 251 are joined to and fixed to outer surfaces of the core plates 260, that is, on opposite sides as the stack of the first and second tubes 210, 270. The EGR gas cooler 200 is connected to the EGR passage (not shown), which allows communication between the exhaust pipe and the intake pipe, through the connection flanges 251. Each of the connection flanges 251 have a generally square or rectangular shape, and is formed with through holes 251*a* as fixing holes to which fixing members such as bolts are inserted to fix the EGR gas cooler 200 to the EGR passage.

The casing 230 includes a first casing member 230A and a second casing member 230B. Each of the first casing member 230A and the second casing member 230B has a substantially U-shape in a cross-section defined in a direction perpendicular to a longitudinal direction of each casing member. Openings of the first and second casing members 230A, 230B are opposed to and connected to each other such that the generally tubular casing 230, having a square or rectangular-shaped cross-section, is formed.

Specifically, the first and second casing members 230A, 230B are placed to cover the stack of the first and second tubes 210, 270 while longitudinal ends thereof are in contact with the core plates 260, and then the perimeters of the openings thereof are overlapped and joined to each other. In the example shown in FIG. 14, the first and second casing members 230A, 230B are joined such that the perimeters of the openings are overlapped. However, the first and second casing members 230A, 230B may be joined to each other by other ways. For example, the first and second casing members 230A, 230B can be joined such that the perimeters of the openings are directly opposed to each other.

The casing 230 is formed with a first expansion (bulge) 231 and a second expansion (bulge) 235. The first expansion 231 expands from a flat side wall 232 of the first casing member 230A in a direction perpendicular to the longitudinal direction of the first and second tubes 210, 270, that is, in a direction parallel to the flat main wall of the first tube 210. The second expansion 235 expands from a flat side wall 232 of the second casing member 230B in a direction perpendicular to the longitudinal direction of the first and second tubes 210, 270, that is, in a direction parallel to the flat main wall of the first tube 210.

The second expansion 235 provides an inner space (communication chamber) that is larger than that of the first expansion 231. The first and second expansions 231, 235 are in communication with coolant passages (second fluid passages) 215, as shown in FIG. 15.

The first expansion 231 is formed with a pipe opening 234, as shown in FIG. 15. A coolant inlet pipe 241 as a joint member is coupled and joined to the pipe opening 234 for introducing the coolant into the EGR gas cooler 200. Likewise, the second expansion 235 is formed with the pipe opening 234. A coolant outlet pipe 242 as a joint member is coupled and joined to the pipe opening 234 of the second casing member 230B for discharging the coolant from the EGR gas cooler 200. The coolant inlet pipe 241 and the coolant outlet pipe 242 are in communication with the engine coolant circuit (not shown).

The casing 230 has the flat side walls 232 as partition walls. As shown in FIG. 15, the flat side walls 232 are in contact with and joined to the side wall of an end first tube 210A, which is one of the first tubes 210 and located adjacent to the second tubes 270. Also, thermal insulation spaces 219 are formed on peripheries of the second tubes 270. Since the side walls 232 of the casing 230 are in contact with the side wall of the end first tube 210A, the thermal insulation spaces 219 are fully separated from the coolant passages 215.

The thermal insulation spaces 219 are filled with air, in place of the coolant. Therefore, radiation of heat of the exhaust gas that passes through the second tubes 270 is reduced.

In the example shown in FIG. 15, the side walls 232 of the casing 230 are also in contact with and joined to side walls of the second tubes 270. However, it is not always necessary that the side walls 232 are in contact with the side walls of the second tubes 270. The side walls 232 of the casing 230 can be separated from the side walls of the second tubes 270. The side walls 232 may not be limited to the flat walls as long as the inner surfaces thereof are in contact with the side walls of the end first tube 210A to separate the thermal insulation spaces 219 from the coolant passages 215.

In the gas cooler 200, the exhaust gas flows in gas passages 214 of the first tubes 210, such as from a left end in FIG. 14, and flows out from the first tubes 210, such as from a right end in FIG. 14. On the other hand, the coolant flows in the coolant passages 215 from the coolant inlet pipe 241 and the first expansion 231. The coolant passes through the coolant passages 215 and flows to the second expansion 235, which is located at a substantially diagonal position with respect to the first expansion 231. The coolant flows out from the EGR gas cooler 200 from the coolant outlet pipe 242.

Thus, in the first tubes 210 that provide the cooling passages C1, heat exchange is performed between the exhaust gas flowing in the gas passages 214 and the coolant flowing outside of the first tubes 210, thereby cooling the exhaust gas. On the other hand, the second tubes 270 that provide the bypass passages B1 are surrounded by the thermal insulation spaces 219. Therefore, the decrease in temperature of the exhaust gas flowing through the gas passages 214 is restricted.

As described above, the inner surfaces of the side walls 232 of the casing 230 are in close contact with the side walls of the first tube 210A, which is located adjacent to the second tubes 270. Therefore, the coolant passages 215 that are formed around the first tubes 210 are separated from the thermal insulation spaces 219. In other words, the cooling passages C1 and the bypass passages B1 are separated from each other without requiring an additional separation plate between the first tubes 210 and the second tubes 270.

In the third embodiment, since the space defined by the second expansion 235 is larger than the space defined by the first expansion 231. Because back pressure of the coolant passages 215 is reduced, the coolant smoothly flows through the coolant passages 215. As such, the heat exchange efficiency further improves.

Also in the EGR gas cooler 200, for example, the inner fins 220 of the second tubes 270 my be replaced into the spacers 121, 111*b*, similar to the second embodiment.

In the first and second embodiments, the shapes of the recesses 113 of the tube main walls 111 may be changed in various ways. In the above embodiments, the depth of the recesses 113 is equal to the height of the projections 112. However, the depth of the recesses 113 may reduced depending on resistance of the coolant to pass through the coolant inlets 113*a*, and the coolant outlets 113*b*. Alternatively, the depth of the recesses 113 may be larger than the height of the projections 112.

Also, the positions of the recesses 113 may be changed. Instead of the diagonal positions, the recesses 113 may be formed on the same side walls 118 of the tubes 110. In this case, the coolant inlet pipe 141 and the coolant outlet pipe 142 are coupled to the same side of the tube stack body L1. Therefore, it is not necessary that the casing 130 is constructed of two separated casing members 130*a*, 130B. The casing 130 may be constructed of a single tank member.

In the above embodiments, the second raised portions 117 are formed parallel to the short side of the rectangular tube main wall 111. However, the second raised portions 117 may be modified in accordance with flow conditions of the coolant. For example, the second raised portion 117 can be inclined relative to the short side of the tube main wall 111 such that a distance between the longitudinal end of the tube 110 and the second raised portion 117 gradually increases with a distance from the coolant inlet 113*a*. Alternatively, the second raised portion 117 may have a curved shape. Further, the second raised portion 117 may be eliminated.

Further, one of or both of the outer walls 131 of the casing 130 may be eliminated in accordance with the required heat exchange efficiency of the exhaust gas. In the first and second embodiments, the spaces 133*a* provided by the bulges 133 may be differentiated to enhance the flow of the coolant in the coolant passages 115, similar to the first and second expansions 231, 235 of the third embodiment.

Also, use of the present invention is not limited to the EGR gas cooler, but can be employed to any other heat exchangers. For example, the heat exchanger 100, 200 can be used as an exhaust gas recovery heat exchanger that performs heat exchange between the exhaust gas, which is discharged to air, and the coolant, thereby to heat the coolant.

In addition, the material of the component parts of the heat exchanger is not limited to stainless steel. The component parts can be made of other materials such as aluminum alloy, or copper alloy, depending on conditions in use.

Additional advantages and modifications will readily occur to those skilled in the art. The invention in its broader term is therefore not limited to the specific details, representative apparatus, and illustrative examples shown and described.

What is claimed is:

1. A heat exchanger for performing heat exchange between a first fluid and a second fluid, comprising:

a plurality of tubes, each of the tubes defining a first fluid passage therein for allowing the first fluid to flow and including tube main walls, wherein at least one of the tube main walls of each tube includes a projection and a recess, the projection projects in an outward direction of the tube along a peripheral end of the tube main wall, the recess is disposed on the peripheral end of the tube main wall and is recessed from an end of the projection, the plurality of tubes are stacked such that the tube main walls are opposed to each other, spaces are defined between the opposed tube main walls of the adjacent tubes and the projections, and openings are provided by the recesses on side walls of the tubes to be in communication with the spaces;

a plate member connected to the plurality of tubes, and including a wall portion and a bulge, wherein the wall portion is disposed along the side walls of the tubes and has an inner surface that closes at least one of the openings such that the space corresponding to the opening closed by the inner surface is closed to provide a thermal insulation space, the bulge expands from the wall portion to define a communication chamber therein, the bulge is defined at a position corresponding to the remaining openings such that the spaces corresponding to the remaining openings are in communication with the communication chamber through the remaining openings and define second fluid passages through which the second fluid flows; and a joint member to be connected to an external circuit through which the second fluid flows, wherein the joint member is connected to the bulge and in communication with the communication chamber.

2. The heat exchanger according to claim 1, wherein the plurality of tubes includes a first outermost tube disposed at a first outermost side, the first outermost tube has a first outermost tube wall that includes an end projection projecting in an outward direction of the first outermost tube along its peripheral end and end recesses recessed from the end projection toward the first outermost tube wall, the heat exchanger further comprising:

a first outer wall member disposed along the first outermost tube wall, wherein an inner surface of the first outer wall member is in contact with the end projection such that a first end space is defined between the inner surface of the first outer wall member and the first outermost tube wall.

3. The heat exchanger according to claim 2, wherein the plurality of tubes includes a second outermost tube disposed at a second outermost side, the second outermost tube has a second outermost tube wall including an end projection projecting in an outward direction of the second outermost tube along its peripheral end and end recesses recessed from the end projection, the heat exchanger further comprising:

a second outer wall member disposed along the second outermost tube wall, wherein an inner surface of the second outer wall member is in contact with the end projection of the second outermost tube wall such that a second end space is defined between the inner surface of the second outer wall member and the second outermost tube wall, and the second outer wall member is connected to the first outer wall member through the plate member.

4. The heat exchanger according to claim 1, wherein wherein each of the recesses has a dimension equal to a dimension of each of the projections, with respect to a direction perpendicular to the tube main walls.

5. The heat exchanger according to claim 4, wherein each of the tube main walls has another recess, and the recess and the another recess are located at diagonal positions.

6. The heat exchanger according to claim 1, wherein the tubes that provide the second fluid passages have flow-adjusting portions on the tube main walls thereof, each of the flow-adjusting portions projects into the second fluid passage and is located at a position corresponding to an upstream location respect to a flow of the first fluid flowing in the first fluid passage, and the flow-adjusting portion is configured such that the second fluid is spread throughout the second fluid passage.

7. The heat exchanger according to claim 1, wherein each of the tubes is constructed of a pair of plate members.

8. The heat exchanger according to claim 1, further comprising a plurality of inner fins disposed in the plurality of tubes.

9. The heat exchanger according to claim 1, further comprising:

a plurality of inner fins disposed in the tubes that provide the second fluid passages; and a plurality of spacers disposed in the tube that provides the thermal insulation space.

10. The heat exchanger according to claim 9, wherein the plurality of spacers is provided by a plurality of projections that project from the tube main walls in an inward direction of the tube.

* * * * *